US005941626A

United States Patent [19]

Yamuro

[11] Patent Number: 5,941,626

[45] Date of Patent: Aug. 24, 1999

[54] LONG LIGHT EMITTING APPARATUS

[75] Inventor: Yukio Yamuro, Tokyo, Japan

[73] Assignee: Hiyoshi Electric Co., Ltd., Tokyo, Japan

[21] Appl. No.: 08/846,760

[22] Filed: Apr. 30, 1997

[30] Foreign Application Priority Data

May 1, 1996 [JP] Japan ..... 8-110774
Aug. 28, 1996 [JP] Japan ..... 8-227072

[51] Int. Cl.[6] ..... F21V 5/00

[52] U.S. Cl. ..... 362/246; 362/240; 362/355; 362/800

[58] Field of Search ..... 313/500, 511, 313/512; 362/240, 244, 246, 249, 278, 320, 800, 255, 355

[56] References Cited

U.S. PATENT DOCUMENTS

| | | | |
|---|---|---|---|
| 1,874,086 | 8/1932 | Dickson | 362/255 |
| 3,737,647 | 6/1973 | Gomi | 362/103 |
| 3,786,499 | 1/1974 | Jankowski et al. | 340/378 R |
| 4,047,075 | 9/1977 | Schoberl | 313/500 |
| 4,143,394 | 3/1979 | Schoberl | 357/72 |
| 4,168,102 | 9/1979 | Chida et al. | 313/111 |
| 4,521,835 | 6/1985 | Meggs et al. | 362/320 |
| 4,733,335 | 3/1988 | Serizawa et al. | 362/800 |
| 4,843,280 | 6/1989 | Lumbard et al. | 313/500 |
| 5,018,053 | 5/1991 | Belknap et al. | 362/104 |
| 5,130,897 | 7/1992 | Kuzma | 362/800 |
| 5,140,220 | 8/1992 | Hasegawa | 313/512 |
| 5,155,669 | 10/1992 | Yamuro | 362/252 |
| 5,193,895 | 3/1993 | Naruke et al. | 362/249 |
| 5,410,458 | 4/1995 | Bell | 362/219 |
| 5,436,809 | 7/1995 | Brassier et al. | 362/249 |
| 5,567,037 | 10/1996 | Ferber | 362/249 |

FOREIGN PATENT DOCUMENTS

| | | | |
|---|---|---|---|
| 0362993A2 | 4/1990 | European Pat. Off. | G02B 5/10 |
| 0805304 A2 | 11/1997 | European Pat. Off. . | |
| 08036368 | 2/1996 | Japan . | |
| 1423011 | 1/1976 | United Kingdom | H05B 33/12 |

*Primary Examiner*—Alan Cariaso
*Attorney, Agent, or Firm*—Elman & Associates

[57] ABSTRACT

A long light emitting apparatus is durable, emits light that can be seen from any direction, and has a low power consumption. The long light emitting apparatus is realized by providing a plurality of LED lamps (light emitting diodes) connected in series at intervals on a connection line. The LED lamp includes an epoxy resin bulb-shaped portion, two leads, and an LED chip connected to the two leads and embedded into the bulb-shaped portion. The surface of the bulb-shaped portion is etched, cut, cut like a diamond, coated with small particles, or covered with an optically-diffusing material so that the emitted light can be diffused and emitted in all directions except backward from the base of the LED lamp. The thus processed surface of the LED lamp can emit light in all directions to be seen from any direction as in the case where filament lamps are used. Since an LED element is used as a light source and the LED lamps are made of resin, the LED lamp is durable. Therefore, the long light emitting apparatus can be easily stored and handled, has a low total power consumption, and is an economical apparatus.

1 Claim, 10 Drawing Sheets

LONG LIGHT EMITTING APPARATUS

BACKGROUND OF THE INVENTION

1. Field of the Invention

The present invention relates to a long light emitting apparatus, provided by connecting a plurality of LED lamps to a flexible conductor, for emitting light approximately equal in brightness in all directions except backward from the bases of the lamps.

2. Description of the Related Art

A conventional long light emitting apparatus has been designed to have a large number of small electric bulbs connected to a long conductor to emit light from the electric bulbs. Such light emitting apparatuses are used as decorative lights applied to streets trees, Christmas trees, etc.

Each of these small lights for the long light emitting apparatus is normally referred to as a filament lamp, and is made of a light emitter of tungsten, opposed electrode foil, etc. covered with a glass bulb. When the bulb is turned on, it emits light by the resistance heat from the tungsten, or by the corona discharge of the opposed electrode foil.

The light is emitted equally in light quantity in all directions except backward from the base (the light is interrupted by the equipment of a socket, a conductor of the bulb, etc.). Therefore, the emitted light can be easily viewed from any direction. Owing to the excellent visibility, the long light emitting apparatus equipped with a large number of electric bulbs connected to a long conductor can be widely used as effective decorative lights both indoors and outdoors, especially as the above described electric decorations in the Christmas season.

However, since each of the above described small bulbs is made of a light emitting unit of tungsten or opposed electrode foil covered with thin glass bulb, it is easily broken when it touches a hard object. Therefore, when the apparatus is stored and used, users should be extremely careful not to break the bulbs, and therefore they feel nervous in handling the bulbs.

Additionally, a filament lamp is normally poor in electro-optical conversion efficiency, and most of the electric power is lost as heat, thereby consuming a large volume of electric power relative to the quantity of emitted light. Therefore, the conventional light emitting apparatus is very uneconomical in simultaneously lighting all of a large number of small filament lamps, even if each of the lamps is very small.

Considering the consumption of electric power only, an LED element is recommended as a light emitter with low electric power consumption. However, the light emitted from the LED element is directional, and indicates an irradiation angle of up to approximately 80 degrees in the front direction of the light emitter. Therefore, LED elements indicating such a narrow optical diffusion are not suitable as decorative lights to be applied to Christmas trees, which are required to emit light in every direction. Actually, the LED elements are normally used as display elements of a device to be viewed from the front. For example, they are applied to time tables provided at stations and airports.

As described above, the LED elements have not been designed to be applied to a long light emitting apparatus to be viewed from all directions. As a result, such a long light emitting apparatus has been equipped with small filament lamps whose irradiation light is non-directional.

SUMMARY OF THE INVENTION

The present invention has been developed to solve the above described problems, and aims at providing a long light emitting apparatus having a plurality of durable LED lamps whose light can be viewed from every direction, with a low power consumption. The apparatus includes a plurality of LED lamps for irradiating light equally in light quantity in all directions except backward from the bases of the LED lamps, and a flexible conductor, connected to each of the electrodes of the plurality of LED lamps, for holding the plurality of LED lamps in an emitting state. The LED lamp is formed by, for example, etching the surface of an LED lamp in the form of frosted glass, cutting the top of the LED lamp in the shape of a bowl, etching the surface of the LED lamp to be like a cut diamond, covering the surface of the LED lamp with small particles of the same material as the body of the LED lamp including an optically-diffusing agent, inside of the LED lamp, or covering the LED lamp with an optically diffusing material. The light from the thus-formed LED lamp can be seen from every direction like a filament lamp and a total power consumption can be reduced, thereby realizing an economical long light emitting apparatus. Since LED lamps are the light sources of the apparatus, the LED lamps are durable and the long light emitting apparatus can be easily stored and handled. When the long light emitting apparatus is used in a transparent hose, the hose enables the series of the LED's to be easily treated and cleaned, with its stable structure, flexibility, and surface-smoothness.

DESCRIPTION OF THE PREFERRED EMBODIMENTS

The preferred embodiments of the present invention are described below by referring to the attached drawings.

Figure 1A:
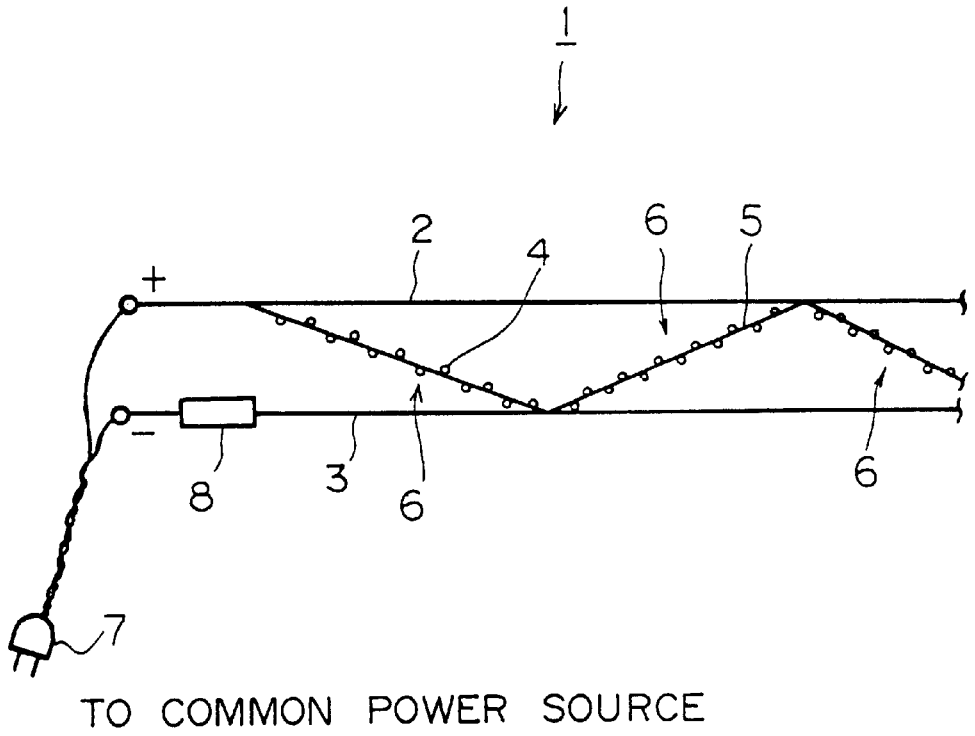
FIG. 1A shows the outline of the configuration of the long light emitting apparatus according to the first embodiment of the present invention.
Figure 1B:
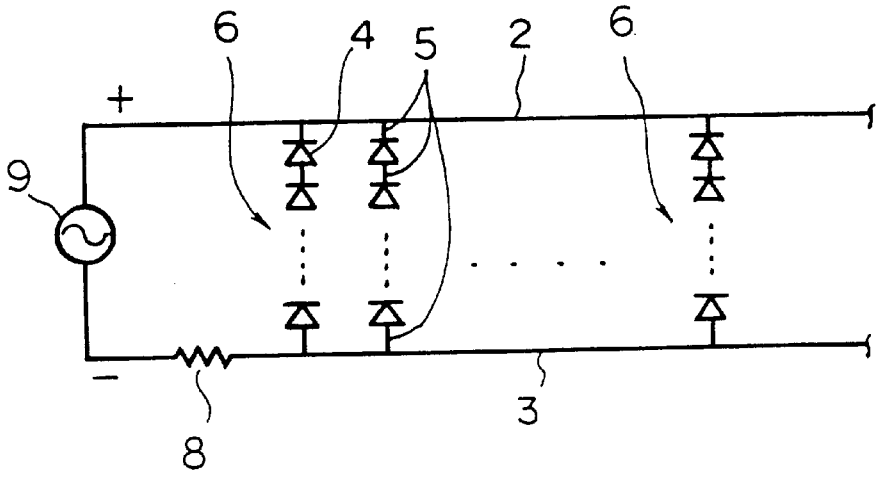
FIG. 1B shows the configuration of the circuit of the long light emitting apparatus according to the first embodiment of the present invention.

FIG. 1A shows the outline of the configuration of the long light emitting apparatus according to the first embodiment of the present invention. A long light emitting apparatus 1 is used for general-purpose illumination. FIG. 1B shows the configuration of the circuit. As shown in FIGS. 1A and 1B, the long light emitting apparatus 1 is designed as a plurality (50 in the present embodiment) of light emitting units 6 having a plurality of LED lamps (light-emitting diodes) 4 connected in series by a connection line 5 between conductors 2 and 3.

The conductor 2 is connected to the anode of the light emitting unit 6, and the conductor 3 is connected to the cathode of the light emitting unit 6. The conductor 2 is connected to one terminal of a power source plug 7 whereas the conductor 3 is connected to the other terminal of the power source plug 7 through a resistance 8. Power source is supplied from a power source 9 through the power source plug 7.

A 2-volt LED lamp 4 is used in the present embodiment. 50 2-volt LED lamps 4 are connected in series for each light emitting unit 6. Therefore, the power source required for each light emitting unit 6 is 100V. Since the required power source of 100V is equal to the common source voltage in Japan, the resistance 8 apparently seems unnecessary. However, it is proved from experience that the apparatus is stable in function by providing the resistance 8. Therefore, the resistance 8 is connected to the circuit shown in FIGS. 1A and 1B. 50 or less LED lamps 4, for example, 45 or 40 LED lamps, can be connected to the light emitting unit 6. In this case, the resistance value corresponding to the potential difference from the power source 9 is set as the resistance 8.

Figure 2:
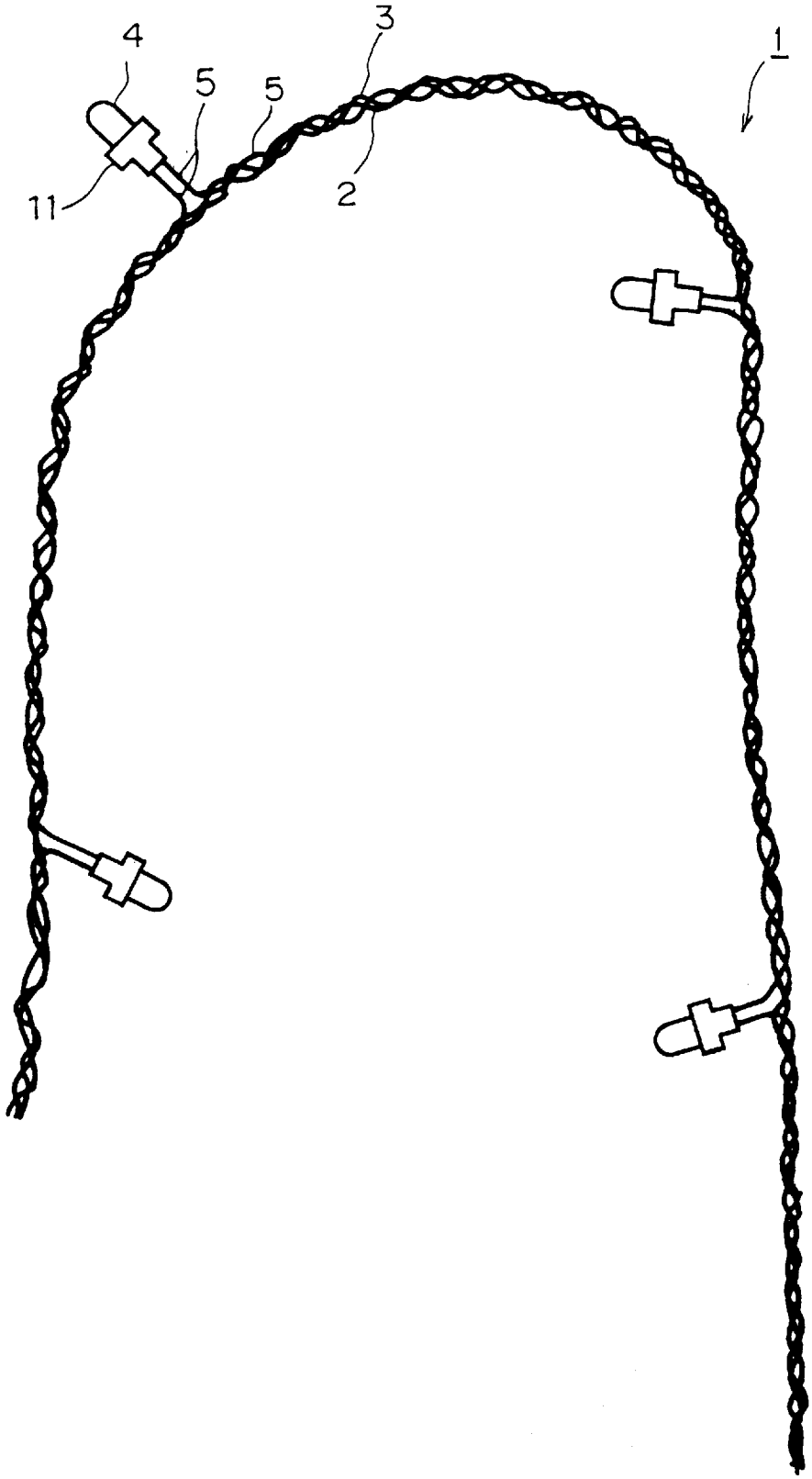
FIG. 2 shows a practical form of the long light emitting apparatus according to the first embodiment of the present invention.

FIG. 2 shows a practical example of the long light emitting apparatus 1. As shown in FIG. 2, the long light emitting apparatus 1 comprises three types of conductors, that is, the conductors 2 and 3, and the connection line 5 of the light emitting unit 6. These conductors are appropriately twisted. The LED lamps 4 are arranged at intervals of approximately 10 cm. In FIG. 2, the resistance 8, power source plug 7, etc. shown in FIG. 1A are omitted. The LED lamp 4 can be connected to the connection line 5 through a socket 11 as shown in FIG. 2. In detail, as described later, a lead of the LED lamp 4 can be directly connected to the connection line 5. Since this long light emitting apparatus 1 is normally required to be very long for outdoor use, a large number of the light emitting units 6 (refer to FIG. 1A) are required. When a long light emitting apparatus 1 is used indoors, it can be short in most cases. Therefore, the long light emitting apparatus 1 can be appropriately divided into sections of light emitting units.

Figures 3A, 3B, 3C, 3D, 3E, 3F:
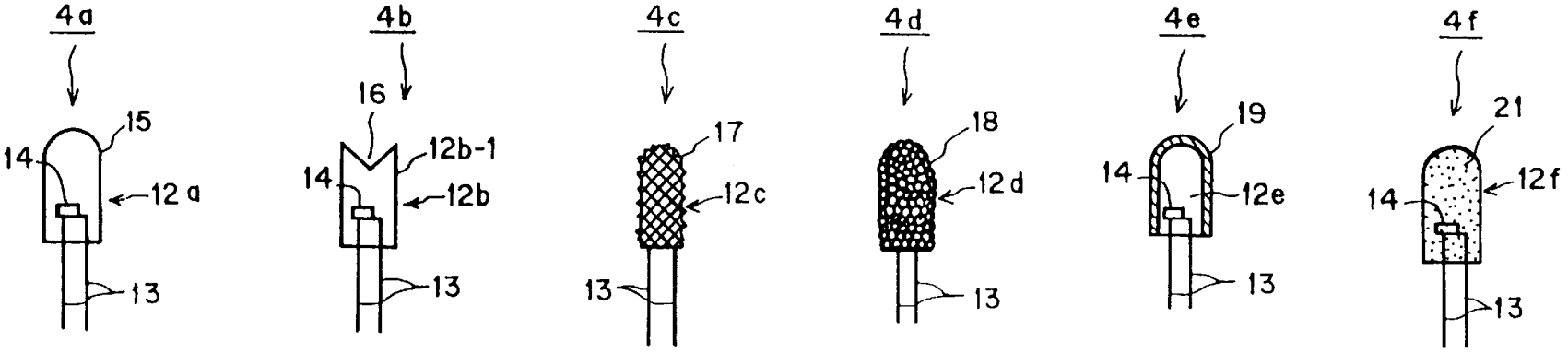
FIG. 3A, 3B, 3C, 3D, 3E and 3F show the configuration of the LED lamp used in the long light emitting apparatus.

FIGS. 3A, 3B, 3C, 3D, 3E, and 3F show the configurations of the LED lamps 4 (4*a*, 4*b*, 4*c*, 4*d*, 4*e*, and 4*f*) connected to the above described long light emitting apparatus 1. FIGS. 3A, 3B, 3E, and 3F are sectional views. FIGS. 3C and 3D are side views.

Each of the LED lamps 4 (4*a*, 4*b*, 4*c*, 4*d*, 4*e*, and 4*f*) shown in FIGS. 3A through 3F comprises an epoxy resin bulb-shaped portion 12 (12*a*, 12*b*, 12*c*, 12*d*, 12*e*, and 12*f*), two leads 13, one end of which is led out of the bulb-shaped portion 12 and the other end of which is led into the bulb-shaped portion 12, and a LED chip 14 (the LED chips 14 are not shown in FIGS. 3C and 3D because they are side views) connected to the other ends of the two leads 13 and included in the bulb-shaped portion 12 together with the other ends of the two leads 13. The diameter of the bulb-shaped portion 12 is approximately 3 mm through 5 mm. The diameter can be larger or smaller than the above described values. The surface of the bulb-shaped portion 12 can be treated in an appropriate process. The material of the bulb-shaped portion 12 is not limited to epoxy resin, but can be any appropriate resin, glass, or other materials.

For example, in the case of the LED lamp 4*a* shown in FIG. 3A, the surface of the bulb-shaped portion 12 is treated to be a frosted glass surface by an etching process 15. As a result, a part of the light emitted by the LED element 14 is refracted in random directions and emitted via the surface of the etched bulb-shaped portion 12*a*, and a remaining part of the light is reflected inside in random directions. A part of the light is refracted again in random directions and emitted via the surface of the bulb-shaped portion 12*a*, and a remaining part of the light is reflected inside in random directions. By repeating this process, the light emitted from the LED lamp 4 is diffused and emitted in all directions except backward from the base of the bulb-shaped portion 12*a*. Thus, the long light emitting apparatus shown in FIG. 2 emits light forward, sideward, and obliquely backward from the bulb-shaped portion 12*a*, as in the case where a small filament light is used. Furthermore, the apparatus has a lower power consumption, and therefore is more economical than the small filament lamp. Thus, the long light emitting apparatus is ideal as an illumination for the Christmas season.

The other five types of the LED lamps 4 shown in FIGS. 3B, 3C, 3D, 3E, and 3F also diffuse and emit light in all directions except backward from the base of the bulb-shaped portion 12. For example, in the case of the LED lamp 4*b* shown in FIG. 3B, a side portion 12*b*-1 of the bulb-shaped portion 12*b* is smooth, but a cone-shaped cut (or formed) portion 16 is designed at the top (on the front) of the LED lamp. If the slope of the cone-shaped surface of the cut (or formed) portion 16 is appropriately set, then a part of the light emitted with a small diffusion angle from the LED element 14 is refracted outside and diffused, and the remaining portion is reflected in the horizontal direction and emitted outside from the side of the LED lamp. In this case, the light is emitted forward, sideward, and obliquely backward from the bulb-shaped portion 12*b*, that is, in all directions except backward from the base of the bulb-shaped portion 12*b*.

In the case of the LED lamp 4*c* shown in FIG. 3C, an irregular diamond-cut surface 17 is provided by etching (or forming) over the entire surface of the bulb-shaped portion 12*c*. Also in this case, the light emitted with a small diffusion angle from the LED element 14 is randomly reflected at the interface between the irregular diamond-cut surface 17 of the bulb-shaped portion 12*c* and the air, and then emitted in all directions except backward from the base of the bulb-shaped portion 12*c*.

Next, the LED lamp 4d shown in FIG. 3D is formed by applying a large number of small particles 18 of the same material as the body of the bulb-shaped portion 12*d* over the bulb-shaped portion 12*d* using a resin adhesive, etc. Also in this case, the light emitted with a small diffusion angle from the LED element 14 is randomly reflected at the interface between the irregular surface of the small particles 18 of the bulb-shaped portion 12*d* and the air, and then emitted in all directions except backward from the base of the bulb-shaped portion 12*d*.

The LED lamp 4*e* shown in FIG. 3E is formed by covering the bulb-shaped portion 12*e* of a normal (unprocessed) LED lamp with an optically-diffusing cap 19. The optical diffusion of the cap 19 can be optionally defined. Since the cap 19 covers a normal LED lamp as described above, an existing LED lamp can be conveniently used. Also in this case, the light emitted with a small diffusion angle from the LED element 14 is diffused by the light diffusion of the cap 19 covering the bulb-shaped portion 12*e* and the air, and then emitted in all directions except backward from the base of the bulb-shaped portion 12*e*.

The examples described above by referring to FIGS. 3A through 3E show respective processes on the surface of the bulb-shaped portion 12*e* of the LED lamp 4. The LED lamp 4*f* shown in FIG. 3F is formed by including an optically-diffusing agent 21 in the bulb-shaped portion 12*f*. The LED lamp 4f appears milky due to the optically-diffusing agent contained in the bulb-shaped portion 12*f*. The light from the LED element 14 of the LED lamp 4f is diffused by the optically diffusing agent 21 and emitted in all directions. However, since a part of the light is absorbed by the optically-diffusing agent, the total quantity of light is reduced by a small amount. Nevertheless, the light output is sufficient for indoor use.

The LED lamp 4 can be directly connected by soldering the lead 13 to the connection line 5. It can also be connected to the connection line 5 by embedding the LED lamp 4 into a socket 11 preliminarily connected to the connection line 5 as shown in FIG. 2.

Figure 4A:
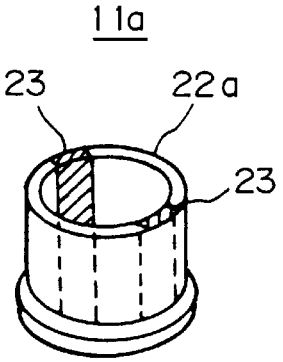
FIG. 4A, 4B and 4C shows three examples of the form of a socket to which the LED lamp is applied.
Figure 4B:
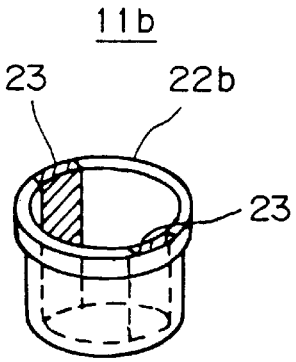
Figure 4C:
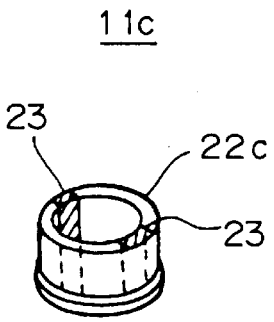
Figure 4D:
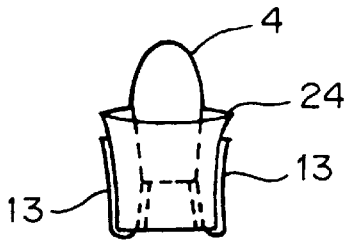
FIG. 4D shows the LED lamp fixed to the socket adapter.

FIGS. 4A through 4C show three examples (11*a*, 11*b*, and 11*c*) of the sockets 11. In these examples, two opposite electrodes 23 are provided inside an insulating circular unit 22 (22*a*, 22*b*, and 22*c*). The two electrodes 23 are connected to the connection line 5 (refer to FIG. 1A). In FIG. 4D, the LED lamp 4 is inserted into a socket adapter 24 (insulating fixture) which makes a matching pair with the socket 11 (11*a*, 11*b*, or 11*c*). The two leads 13 extending down from the base of the LED lamp 4 are pulled upward along the outside of the socket adapter 24. Thus, the socket adapter 24, to which the LED lamp 4 is inserted, is embedded into the socket 11 with the two leads 13 in contact with the two electrodes 23. The form of the socket is not limited to the above three examples, but can be any other appropriate forms.

Figure 5:
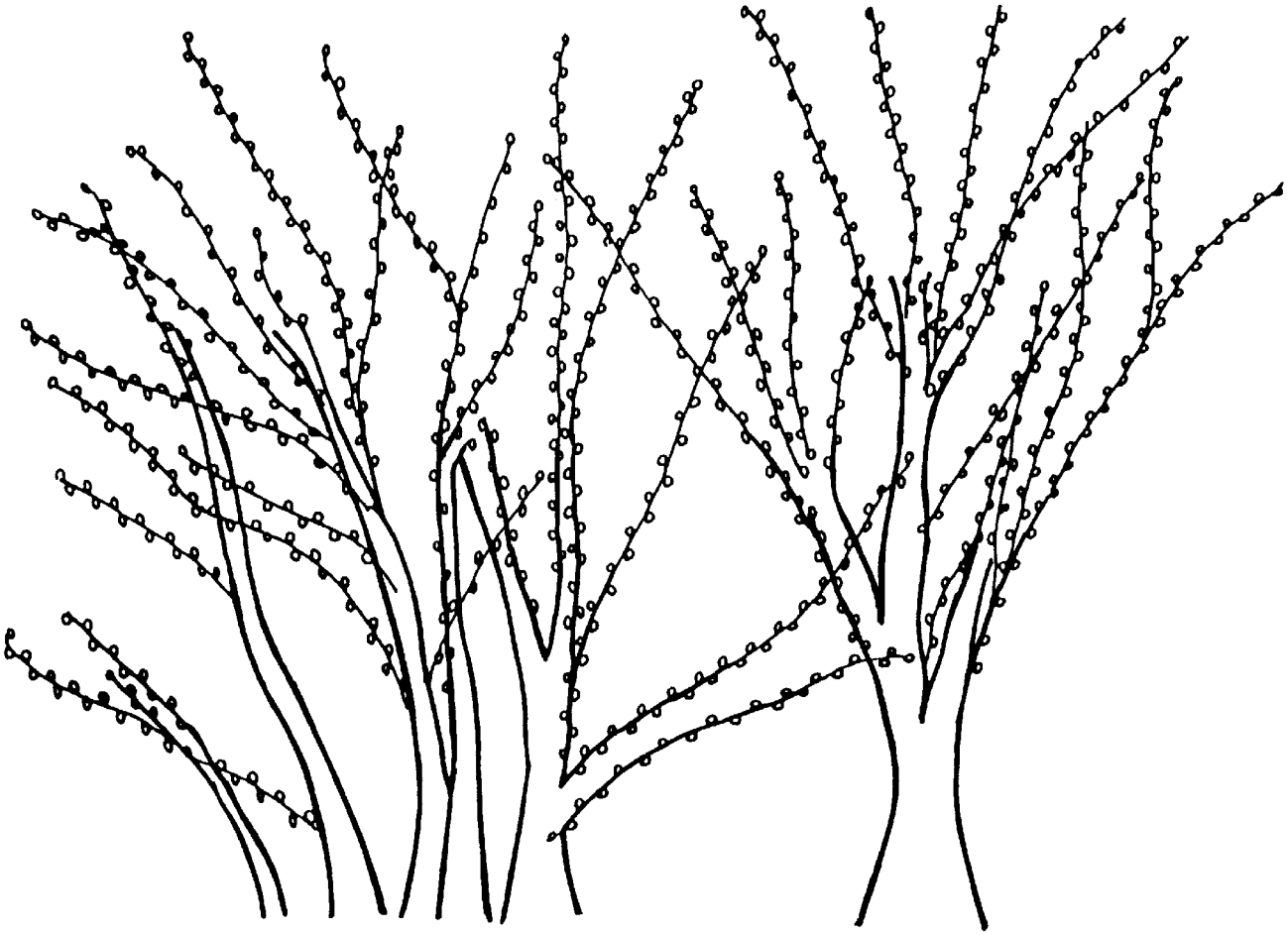
FIG. 5 shows an example of the state of the long light emitting apparatus according to the first embodiment when it is applied to a large tree in a park, etc.
Figure 6:
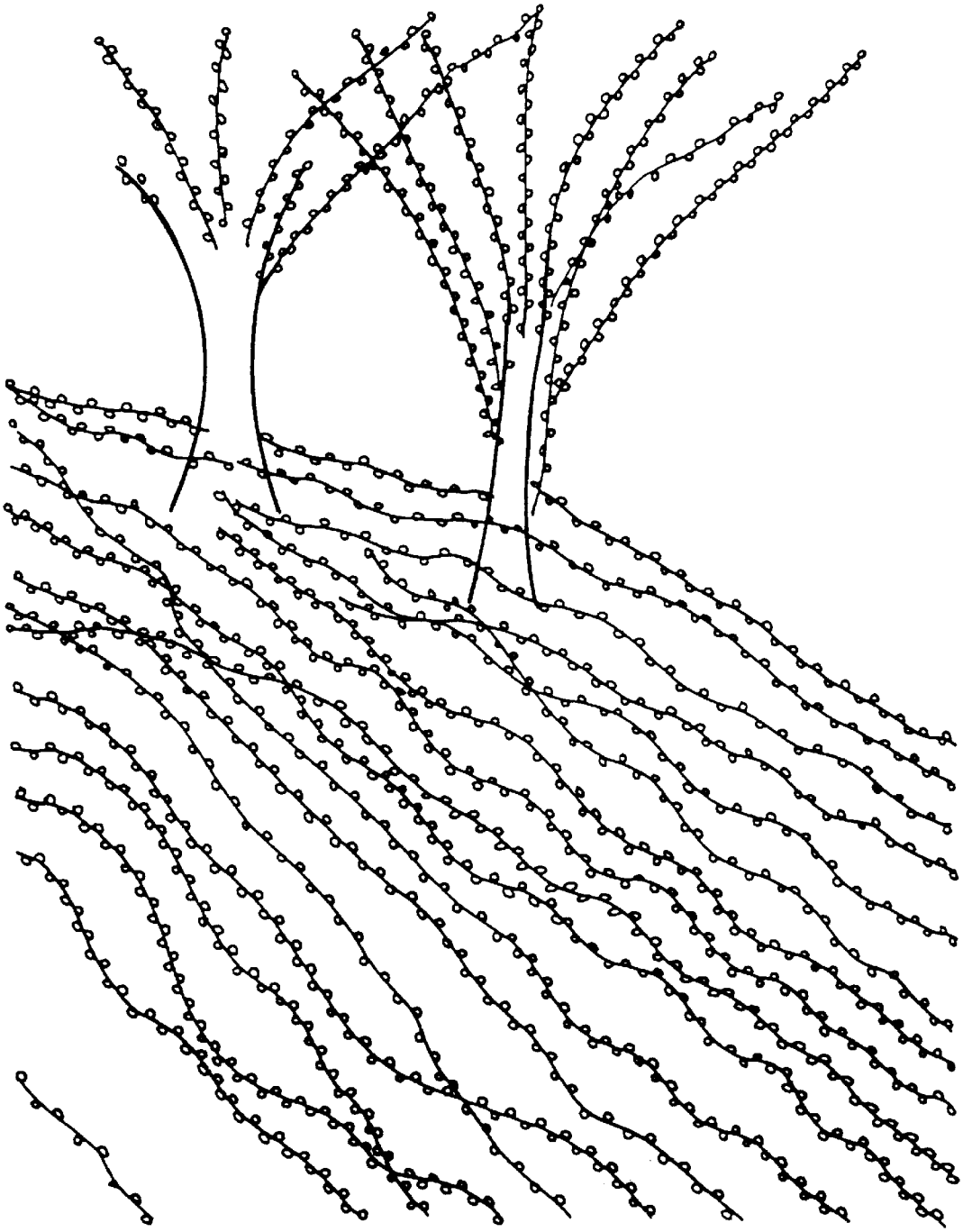
FIG. 6 shows an example of the state of the long light emitting apparatus according to the first embodiment when it is applied to a slope of grass under trees.
Figure 7:
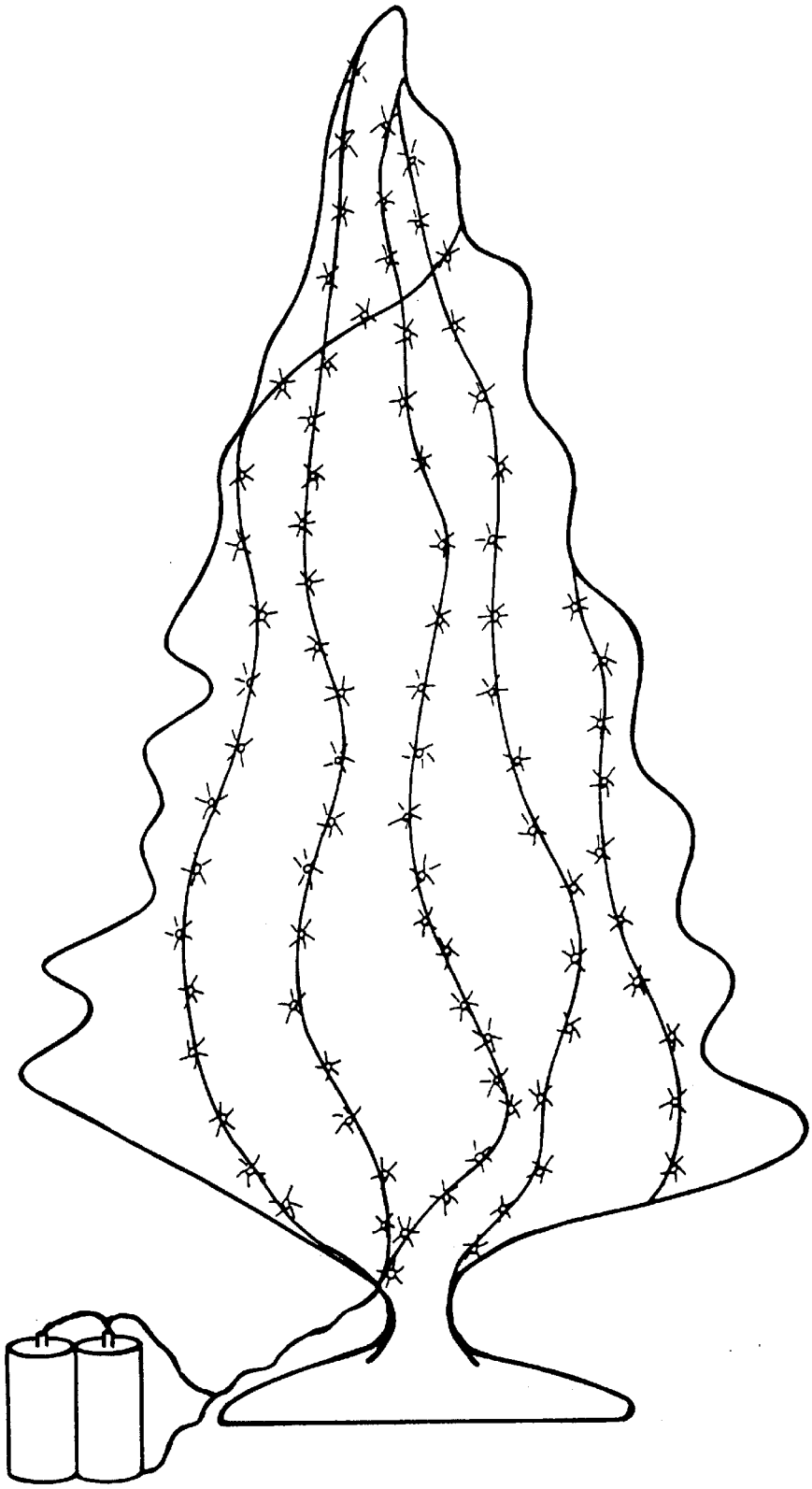
FIG. 7 shows an example of the state of the long light emitting apparatus according to the first embodiment when it is applied to a home Christmas tree.

FIGS. 5 through 7 show examples of the long light emitting apparatus 1. FIG. 5 shows the long light emitting apparatus 1 arranged in branches of a large tree in a park, etc. Since the light emitted from the LED lamp 4 of the long light emitting apparatus 1 is emitted in all directions from the LED lamp except backward from the base of the LED lamp, the long light emitting apparatus 1 can be simply arranged along each branch without considering the direction of the LED lamps 4. The light can be equally viewed from any direction, and is emitted non-directionally as with small filament lamps.

Next, FIG. 6 shows an example of the state of the long light emitting apparatus 1 arranged on grass which gently slopes away from the base of the above described tree. This is to create an artificial expression of a clear stream of running water. Also in this case, a plurality of long light emitting apparatuses 1 can be arranged at appropriate intervals over the slope without considering the direction of the LED lamps 4. According to the long light emitting apparatus 1, the entire power consumption is not large even if a large number of LED lamps 4 are used as shown in the above described examples. For example, if 1000 LED lamps 4 are applied, and the power consumption for each LED lamp 4 is 0.02 W, therefore 1,000 LED lamps require 20 W. This equals the power consumption of one common fluorescent lamp. On the other hand, a common filament lamp consumes 0.48 W. Therefore, 1000 lamps require 480 W, which is 24 times as much as the LED lamps. 480 W equals the power consumed by a small size domestic cleaner, and is a considerable power consumption for continuous use.

FIG. 7 shows an example of the long light emitting apparatus 1 applied to a home Christmas tree. When the long light emitting apparatus 1 is used indoors, the long light emitting apparatus 1 can be used after dividing into appropriate lengths in units of the light emitting unit 6.

When the long light emitting apparatus 1 is used outdoors, especially when it is used on the ground as shown in FIG. 6, the LED lamps 4 will probably not be broken even if they are mistakenly stepped on. If they are filament lamps, they are easily broken. Furthermore, any tools used outdoors easily get dirty. Normally, a long light emitting apparatus having a number of concave and convex portions easily gets dirty and is cleaned with difficulty.

Figure 8A:
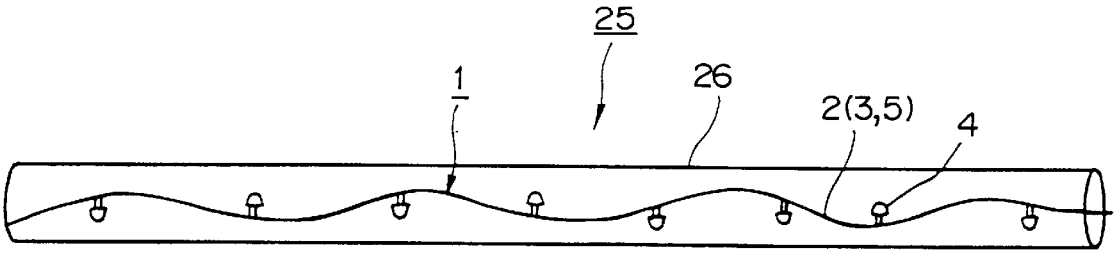
FIG. 8A shows the outline of the configuration of the long light emitting apparatus according to the second embodiment of the present invention.
Figure 8B:
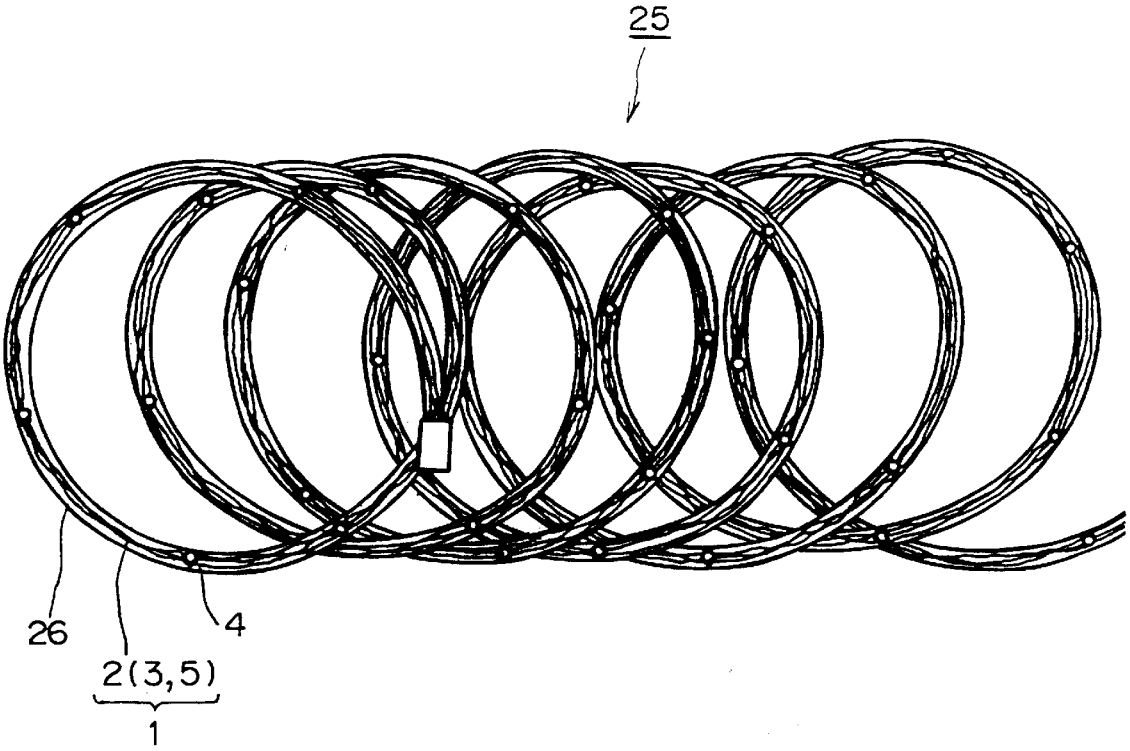
FIG. 8B shows the practical state of the long light emitting apparatus according to the second embodiment of the present invention.

FIGS. 8A and 8B show the second embodiment of the present invention in which the long light emitting apparatus can be prevented from getting dirty. FIG. 8A shows the outline of the configuration of the long light emitting apparatus. FIG. 8B shows a practical configuration of the long light emitting apparatus. As shown in FIGS. 8A and 8B, a long light emitting apparatus 25 is designed to have the above described long light emitting apparatus 1 contained in a flexible transparent hose 26. Since the surface of the transparent hose 26 is smooth without concave or convex portions, it does not easily get dirty. Even if it gets dirty, it can be easily cleaned with cloth or tissues. Furthermore, since such a transparent hose 26 is stored after being wound like a coil, it has the property of maintaining its coil form. Therefore, the long light emitting apparatus 25 shown in FIG. 8 contained in the transparent hose 26 can be easily stored because it maintains its form more easily than the long light emitting apparatus 1 having an uncertain form and comprising a twisted wire of the conductors 2 and 3 and the connection line 5. Furthermore, when the long light emitting apparatus 25 is arranged as an electric light ornament, it is more easily handled because of its smooth surface. Additionally, the transparent hose 26 is effective in adding brightness to the light because it further refracts the light emitted from inside.

Figure 9B:
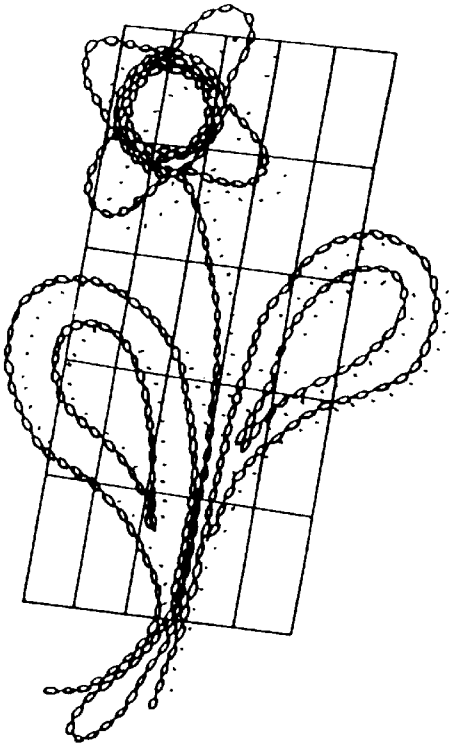
FIG. 9B shows an example of the state of the long light emitting apparatus arranged as a large flower lighted up in the dark according to the second embodiment of the present invention.
Figure 9A:
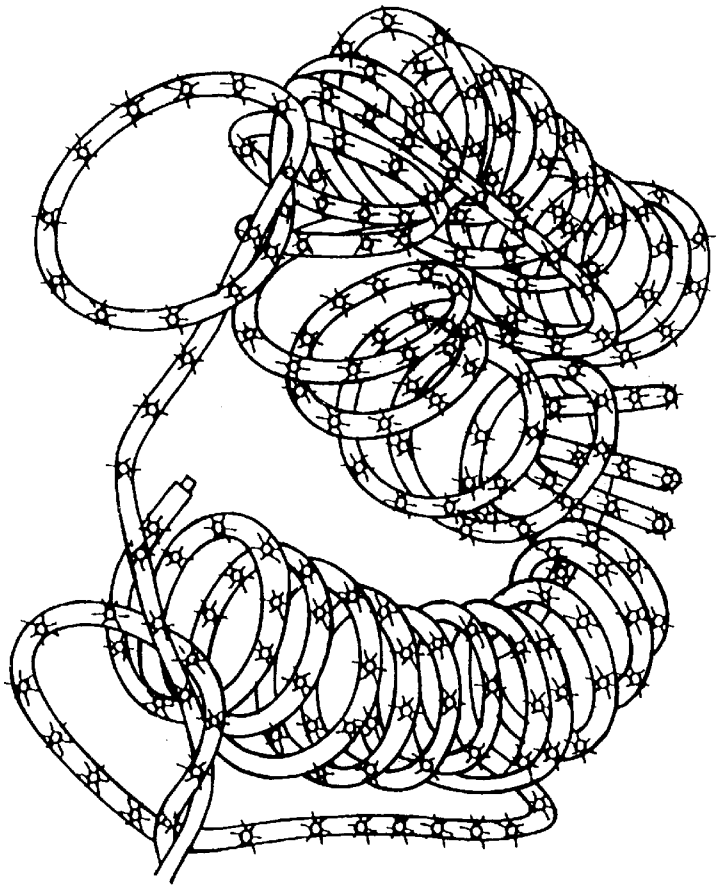
FIG. 9A shows an example of the state of the long light emitting apparatus arranged as a modern art ornament according to the second embodiment of the present invention.

FIGS. 9A and 9B show examples of the long light emitting apparatus 25. FIG. 9A shows an attractive electric light ornament as a modern art based on the property of a coil of the long light emitting apparatus 25. FIG. 9B shows an example of a large flower lighted in the dark with a large grid frame supporting the flower structure.

In each of the above described embodiments, the LED lamps are used as electric light ornaments. However, the use of the long light emitting apparatus according to the present invention is not limited to an electric light ornament. The long light emitting apparatus is also effective when it is used as an object to attract people's attention in a position where many people should stop and see, for example, a warning. Described below is the third embodiment of the long light emitting apparatus used as a warning object.

Figure 10A:
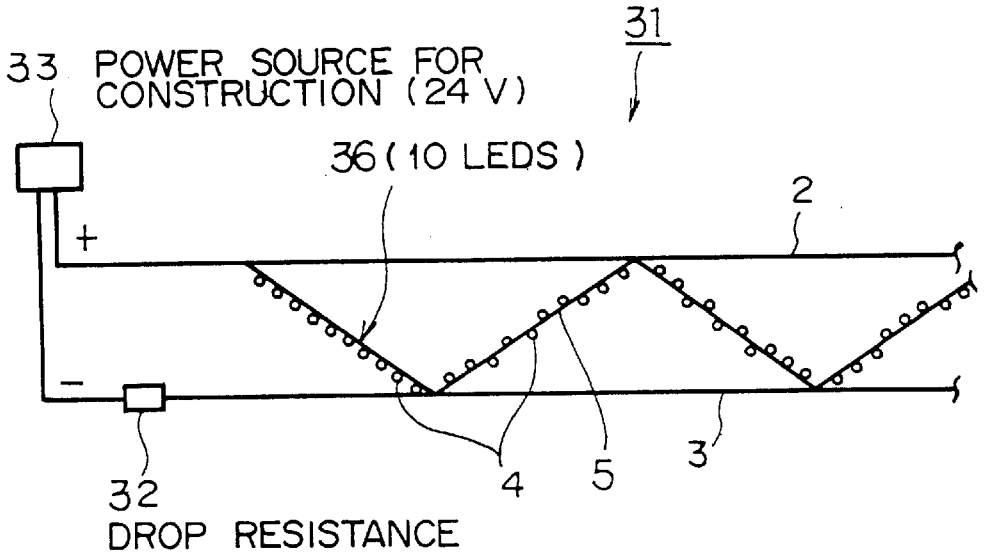
FIG. 10A shows the outline of the configuration of the long light emitting apparatus arranged as an area indicator in a construction field according to the third embodiment of the present invention.
Figure 10B:
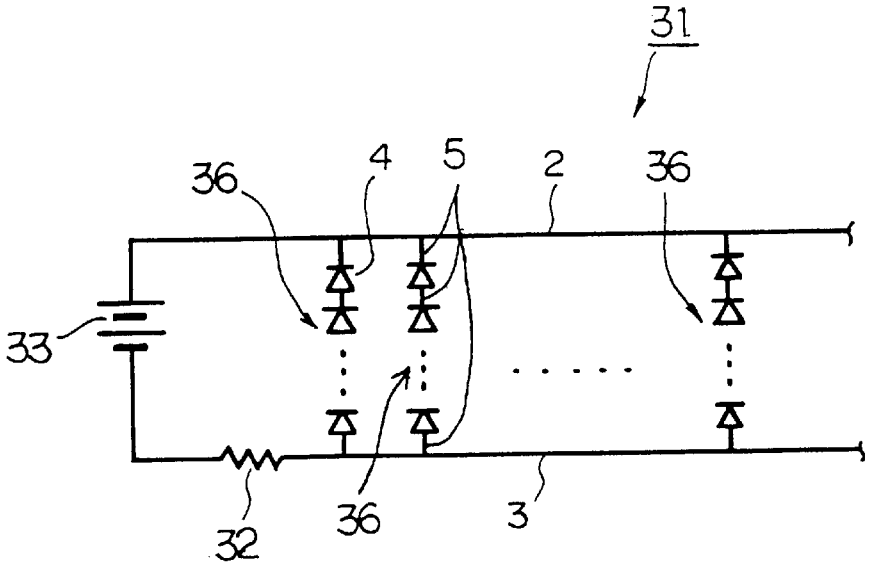
FIG. 10B shows the circuit of the long light emitting apparatus according to the third embodiment of the present invention.

FIGS. 10A and 10B show the configuration of the long light emitting apparatus used as a passage area indicator to clearly indicate the passage area separated from the construction area in a construction site, for example, a road construction. FIG. 10A shows the outline of the configuration of the passage area indicator. FIG. 10B shows the circuit of the passage area indicator. As shown in FIGS. 10A and 10B, a long light emitting apparatus 31 is basically the same as the long light emitting apparatus 1 shown in FIGS. 1A and 1B, and is different from it only in circuit configuration. That is, the long light emitting apparatus 31 comprises a light emitting unit 36, provided between the conductors 2 and 3, having ten LED lamps 4 connected in series as shown in FIGS. 10A and 10B. In this case, the power source for each of the LED lamps 4 can be, for example, 2V. The power source connected to the long light emitting apparatus 31 is a power source for a construction site. The power source for a construction site is normally 24V in Japan. Therefore, the number of LED lamps 4 installed in the light emitting unit 36 in this case is ten as shown in FIG. 10. Since the total power source requirement of the light emitting unit 36 is 20V, this indicates that the voltage between the conductor 2 and the conductor 3 is 4V higher. Therefore, in this case, a voltage drop resistance 32 is connected to the conductor 3 at the cathode, and the conductor 3 is connected to a power source for a construction site 33 through the voltage drop resistance 32. The practical form of the long light emitting apparatus 31 is almost the same as in the case shown in FIG. 2. The LED lamps 4 can be optionally arranged at, for example, 50 cm intervals.

What is claimed is:

1. A flexible long light emitting apparatus, comprising:

a flexible conductor comprising at least two flexible, electrically conducting wires twisted together and a plurality of light emitting diode lamps connected across said electrically conducting wires, each lamp comprising:

a resin or glass body having a generally bulb-shaped portion, said bulb-shaped portion having a base end, a light emitting diode chip positioned in the base end of said bulb-shaped portion;

said body having an external surface formed as a frosted surface;

said base end having electrodes extending therefrom for connecting said light emitting diode chip to said wires, wherein said external frosted surface of said body is adapted so that diffused light is emitted by the lamp in all directions except backward from said base end.

* * * * *